US008448264B2

(12) United States Patent
Ellsworth

(10) Patent No.: US 8,448,264 B2
(45) Date of Patent: May 28, 2013

(54) RAPID OPENING FEATURE ON TACTICAL JACKET

(75) Inventor: Chris Ellsworth, Modesto, CA (US)

(73) Assignee: 5.11 Inc., Modesto, CA (US)

( * ) Notice: Subject to any disclaimer, the term of this patent is extended or adjusted under 35 U.S.C. 154(b) by 304 days.

(21) Appl. No.: 12/804,564

(22) Filed: Jul. 23, 2010

(65) Prior Publication Data

US 2012/0017348 A1 Jan. 26, 2012

(51) Int. Cl.
*A41D 1/00* (2006.01)
*A41D 1/02* (2006.01)

(52) U.S. Cl.
USPC ..... 2/96; 2/108

(58) Field of Classification Search
USPC ..... 2/108, 85, 93–96, 69, 69.5, 79, 80, 2/83, 114, 115, 102, DIG. 1; 24/421, 419, 24/429, 430
See application file for complete search history.

(56) References Cited

U.S. PATENT DOCUMENTS 2,632,933 A * 3/1953 Firing ..... 24/436
2,688,138 A * 9/1954 Glass ..... 2/234
3,116,491 A * 1/1964 Previdi et al. ..... 2/106
4,966,320 A 10/1990 Desantis et al.
5,105,477 A * 4/1992 Golde ..... 2/93
5,505,355 A 4/1996 Williams
5,692,237 A 12/1997 Bennett
5,799,329 A * 9/1998 Hauschild ..... 2/102
5,836,310 A * 11/1998 Winters et al. ..... 128/845
5,907,869 A * 6/1999 Bohn et al. ..... 2/102
6,209,176 B1 * 4/2001 Anscher ..... 24/429
6,760,922 B1 7/2004 Morales
6,986,164 B1 1/2006 Morales
8,201,271 B2 * 6/2012 Dennis ..... 2/102
2005/0223466 A1 10/2005 Jennings et al.

* cited by examiner

*Primary Examiner* — Gloria Hale
(74) *Attorney, Agent, or Firm* — Thomas M. Freiburger

(57) ABSTRACT

A jacket for tactical use by police, for example, has a side opening just below the arm to the bottom of the jacket, with a quick-opening feature for fast access to a weapon secured under the jacket. The side opening is closed by a zipper pulled downwardly, concealed by a flap when closed. A small gripping tab extends out at the exterior of the jacket near the bottom edge, at the end of a rip cord secured to a buckle or clip positioned along the inside surface of the jacket. The clip snaps together to hold the jacket opening secured at bottom. When the rip cord is pulled, this has the effect of releasing the buckle and opening the zipper to separate the jacket along the opening line. The wearer can thus quickly reach a weapon or other implement by a rapid one-handed pull of the rip cord.

9 Claims, 5 Drawing Sheets

RAPID OPENING FEATURE ON TACTICAL JACKET

BACKGROUND AND SUMMARY OF THE INVENTION

This invention is concerned with garments, especially tactical garments for personnel carrying concealed weapons. In particular the invention encompasses a jacket, windbreaker or other upper garment with a quick-opening feature at the side for fast access to a weapon or other item when needed.

Vests, jackets and shirts have been known for the purpose of allowing police or other armed personnel quick access to a concealed weapon. See, for example, 5.11 Inc. U.S. Pat. Nos. 6,760,922 and 6,986,164. The tactical garments of these patents allow fast access to a gun or other weapon carried in the garment itself along the chest or below the armpit of the user.

A handgun is often carried at the user's side, either with a shoulder holster or with a hip-mounted holster, but in either event concealed by a garment, which may be a jacket, coat or windbreaker that lies over and covers the weapon. There is a need for a jacket, coat or windbreaker that, while hiding a weapon retained at the side of the user, provides for quick access to the weapon by opening of the jacket with a single hand.

The invention fills this need with a coat, jacket, vest or windbreaker (hereinafter "jacket") that has a slit opening down one or both sides, preferably from just below the armpit or armhole to the bottom edge of the jacket, closed with a non-locking zipper by downward pull of the zipper's slider. The zipper is essentially concealed by a flap when closed. At the exterior of the jacket near the bottom edge, a rip cord that extends through an opening in the jacket, with a small gripping tab at the end of the cord. The cord is secured to a plastic buckle or clip somewhat similar to a backpack buckle, positioned along the inside surface of the jacket so as to be hidden from the outside. The buckle or clip snaps together to hold the closed jacket opening secured at bottom. When the rip cord is pulled, a spring-biased rocker of the buckle is lifted, which releases the buckle, pulls the front portion of the jacket away from the rear portion and causes opening of the zipper to separate the jacket along the opening line, up to just below the arm if desired. The weapon is then exposed for access. The wearer can thus quickly reach a weapon or other implement by a rapid one-handed pull of the rip cord.

It is among the objects of the invention to allow fast access to a weapon retained at a user's side, by a jacket that normally conceals the weapon but which can be rapidly opened along a side opening line by a single pull of a release cord or rip cord to simultaneously release a locking clip securing the opening at the bottom, unzip the zipper and fully separate the jacket at the opening. These and other objects, advantages and features of the invention will be apparent from the following description of a preferred embodiment, considered along with the accompanying drawings.

DESCRIPTION OF PREFERRED EMBODIMENTS

Figure 1:
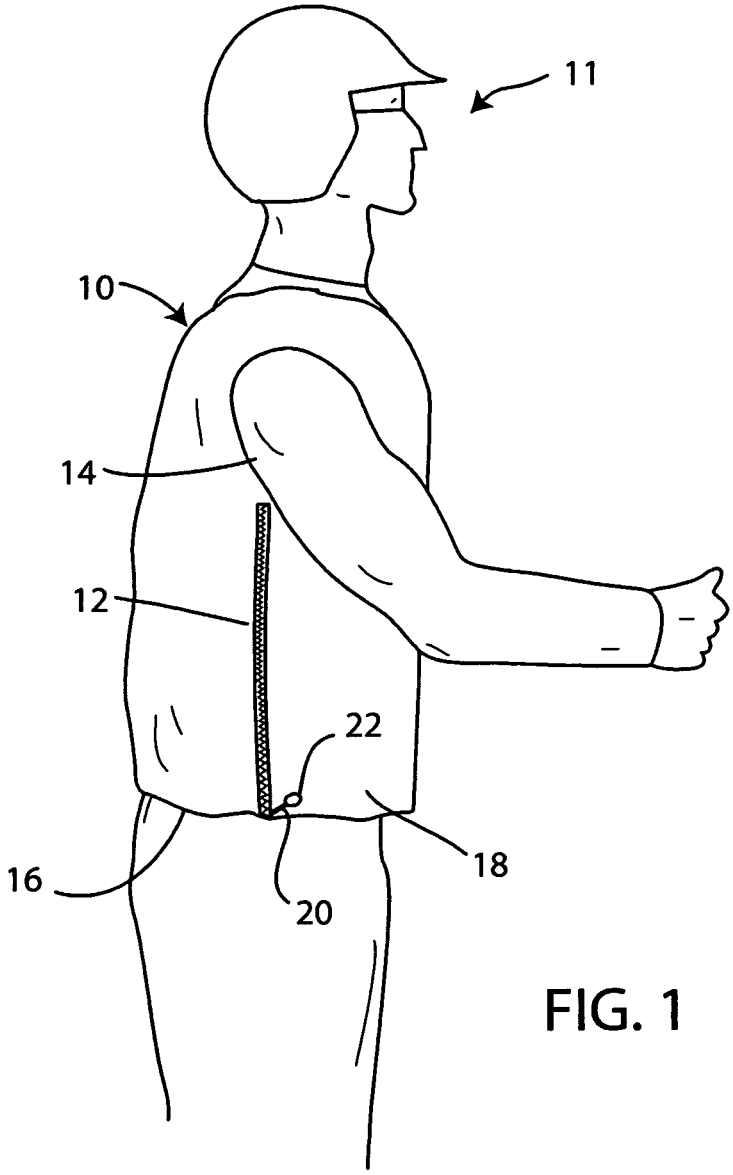
FIG. 1 is view showing a jacket of the invention as worn by a person so as to conceal a weapon, the jacket having a side access opening.

FIG. 1 shows a jacket 10 worn by a person 11, typically a law enforcement officer or other tactical or military personnel. The jacket has at least one side opening 12, preferably arranged vertically and extending to just under the arm 14 of the wearer. In a preferred embodiment the side access opening can extend up to within about two inches below the armpit. The zipper can also be continuous to the armpit and beyond (e.g. to the elbow), with the upper sleeve portion serving as a vent. Near the bottom edge 16 of the jacket, in a front portion 18 of the jacket and just forward of the side access opening 12, is a pull cord or rip cord 20 with a small gripping handle 22 at its end. Pulling of this rip cord by the wearer is effective to release a locking closure at the bottom edge and fully separate the opening in one quick motion, with a single hand.

Figure 2:
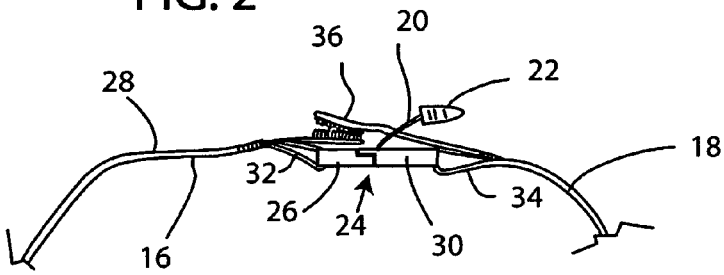
FIG. 2 is a detailed bottom view showing a portion of the jacket along the bottom edge, at the side access opening.
Figure 3:
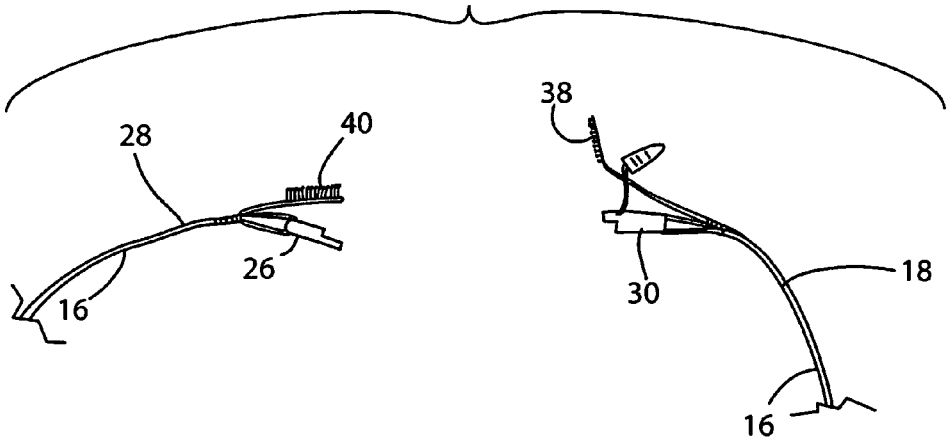
FIG. 3 is a view similar to FIG. 2 but showing the jacket's bottom edge separated after a release cord has been pulled.

FIG. 2 shows a portion of the jacket 10, looking up at the bottom edge 16 and revealing the rip cord 20, the gripping handle 22 and a buckle or clip 24, preferably of plastic, which locks the access opening in the closed position. The buckle may be generally of a type used in baby car seats or for backpack straps, and can be any suitable buckle which has a locking device that can be pulled outwardly to release the buckle. Two components, a first component 26 preferably being secured to a rear portion of the jacket and a second buckle component 30 being secured on the front portion 18 of the jacket, are shown snapped together in locking position in FIG. 2, but separated in FIG. 3. The buckle is at the inner side of the jacket, not seen from the outside and thus not visible in FIG. 1. Short straps 32 and 34, each anchored to the respective jacket panel, retain the buckle components 26 and 30 to the jacket. As the drawing shows, the pull cord or rip cord 20 extends through an opening in the jacket panel 18. When the rip cord is pulled outwardly via the gripping tab 22, this lifts a spring-biased release lever or rocker of the buckle component 30, releasing the two components. The continued pull on the rip cord opens the jacket by opening a non-locking zipper (not shown in FIGS. 1, 2 and 3) that lies normally hidden by a flap 36 of the jacket panel 18, fully separating the jacket opening and allowing access to a concealed weapon at the user's side. Preferably the closure includes small patches of hook and loop fasteners (e.g., VELCRO) indicated at 38 and 40, respectively. The pulling open of the jacket also releases the hook and loop VELCRO connection.

Figure 4:
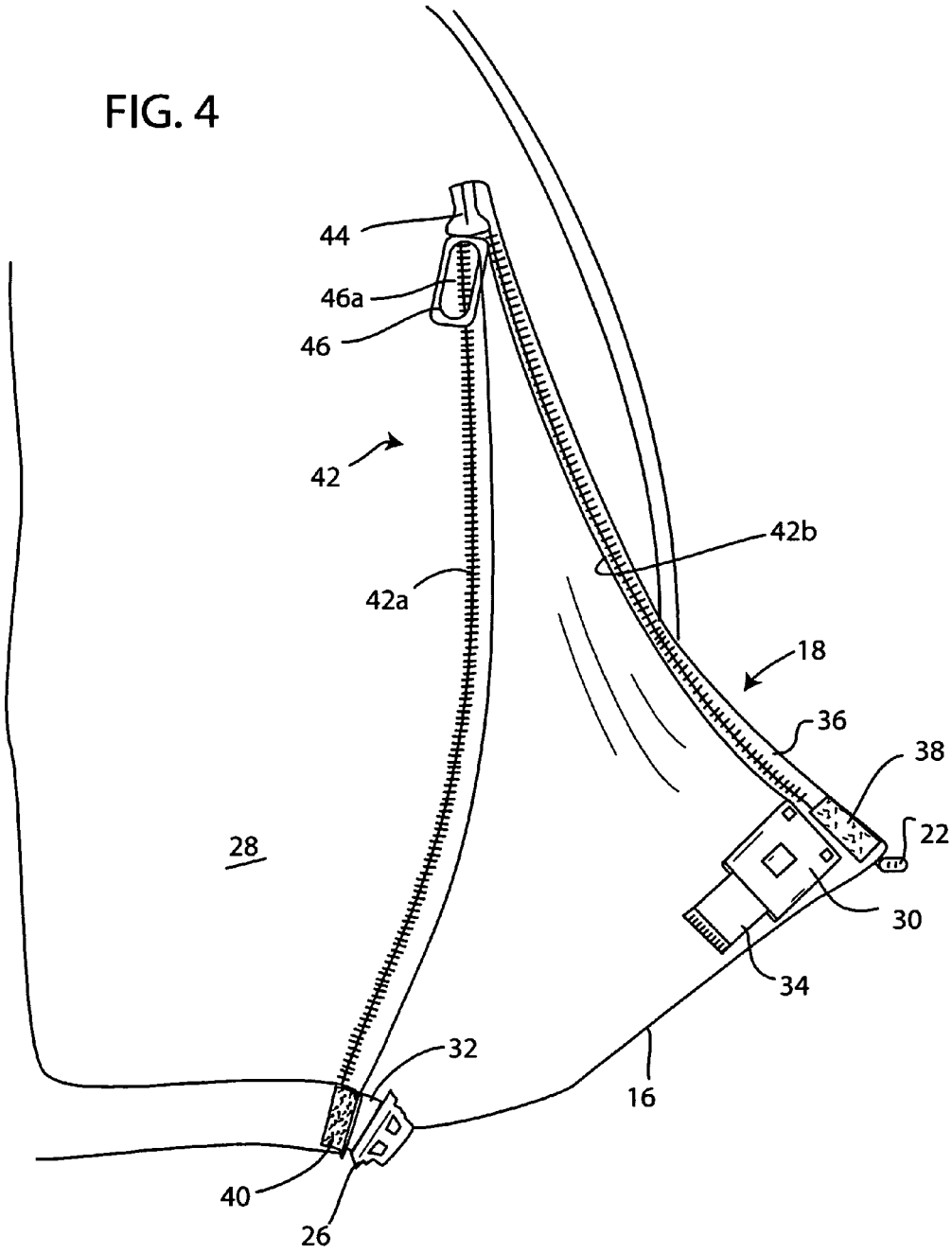
FIG. 4 is a view showing the access opening fully opened after pulling of the release cord.

FIG. 4 shows the side of the jacket with the access opening fully separated. The zipper 42, comprised of separable zipper strips 42*a* and 42*b*, is shown fully open, with a zipper slider 44 at a topmost position. A zipper pull ring 46 is shown connected to the zipper slider, for pulling the slider down to close the zipper. This pull ring preferably is rectangular shaped generally as shown, with a large central opening 46*a* so that the pull ring can be positioned between the hook and loop fastener patches 38 and 40 and captured between these fasteners, allowing them to engage via the central ring opening 46*a*.

The zipper automatically separates when the front panel or jacket portion 18 is pulled away from the rear panel 28 by the user's pulling the rip cord 22, causing the zipper slider 44 to slide upwardly as the zipper opens.

Thus, with one continuous pulling motion on the rip cord, the locking buckle 24 is released and opened, the hook/loop fastening 38, 40 is released, releasing the zipper ring 46, and the zipper is fully opened, since the non-locking slider is caused to travel up the zipper path until no further pull force is exerted. This can be done with one hand of the user if desired, while the other reaches for a handgun or other weapon.

Figure 5:
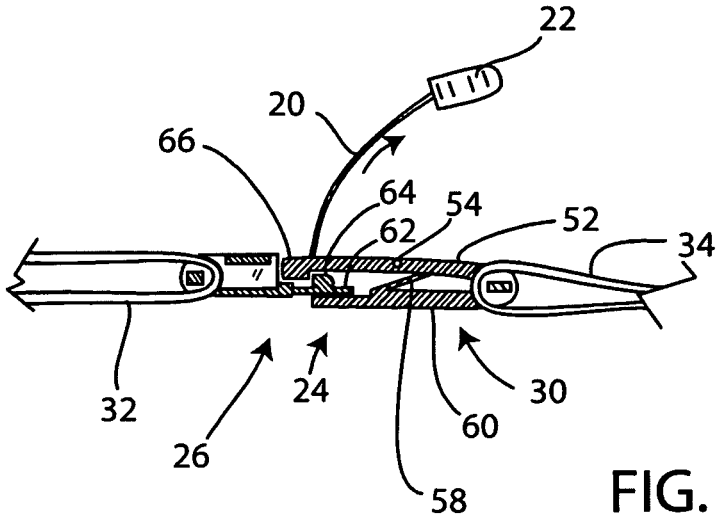
FIG. 5 is a detailed view showing a locking clip or buckle forming a part of the invention.
Figure 6:
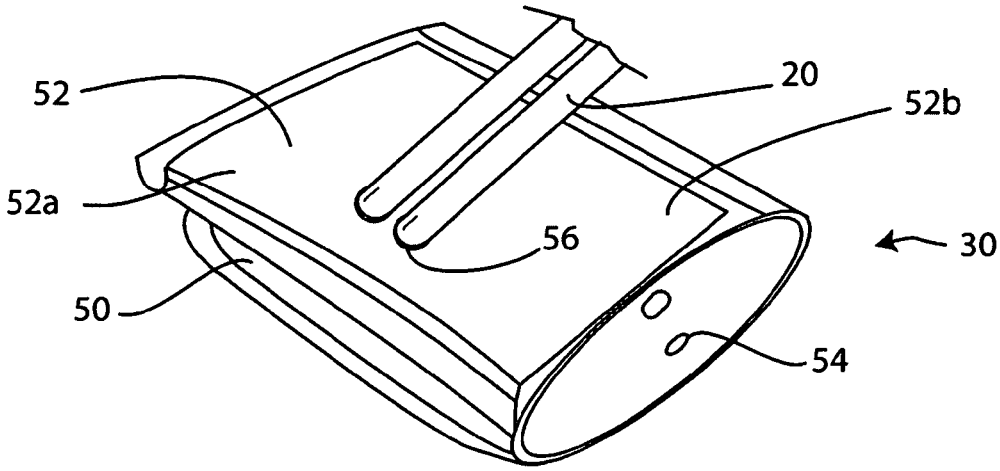
FIG. 6 is a perspective view showing a component of the clip or buckle.

FIG. 5 is a side elevation view in section showing one type of buckle 24 suitable for use in the invention. The latching component 30 of the buckle is also shown in FIG. 6. FIG. 6 shows that the component 30 has an open forward end 50 to receive the other component 26. The receiving or latching component 30 has a latching lever or rocker 52, pivoted on an axis indicated at 54. It is spring-biased so that the forward end 52*a* is urged downwardly to lock the other component 26 in position when engaged. Although the rocker could be released by pushing down on a rear end 52*b*, in the current application it is rotated and released by pulling the cord 20, which, as illustrated, preferably comprises a cord looped down and returned through holes 56 in the forward end of the lever. FIG. 5 shows the two components latched together. The spring may comprise a plastic leaf spring 58 which is comprised of a portion of a bottom platform 60 of the component 30, extending upward into engagement with the bottom of the latch lever 52 and deflectable downwardly during release. The other component 26 has a plate-like tab 62 that extends into the receiving component 30, and this plate-like tab has barbs 64 that extend upwardly but are tapered down in the forward direction so as to enable sliding into the component 30, displacing the front edge of the lever 52 upwardly and then latching into place. The latching is done by a ledge 66 that extends down at the front of the latching lever 52, preventing the barbs 64 from pulling outwardly until the cord 20 is pulled to release the lever. Plastic buckles of this type are known in other contexts, typically released by pushing down on the back end 52*b* of the latching rocker 52.

Figure 7:
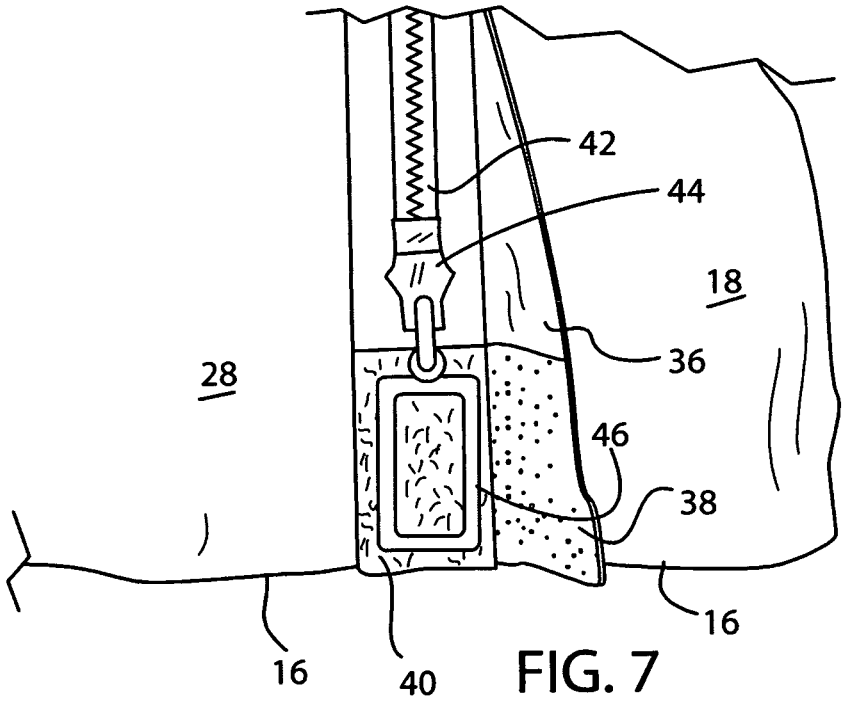
FIG. 7 is a side view of the jacket showing a zipper in closed position.

FIG. 7 shows the zipper 42 closed, with the zipper slider 44 in a downward position. The ring pull 46 for the zipper slider is shown stowed against the VELCRO patch 40 just below the zipper, adjacent to the bottom edge 16 of the jacket, in what is the rear panel 28 in the embodiment shown. The ring is open in this way so that the opposite hook/loop patch 38, shown pulled open in this view, can engage the hook/loop patch 40 with the pull ring 46 between. In this way the zipper, slider and zipper pull are all concealed by the closure flap 36 when the access opening is closed. The hook/loop fasteners keep the non-locking zipper slider from being moved upward unintentionally.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A jacket having a quick opening feature, comprising:

a jacket body configured to cover at least the torso of a user, the jacket having a bottom edge at a position to be essentially below the waist of a user, a generally vertically extending access opening at one side of the jacket, positioned to be at one side of a user when worn, the opening extending at least part way up toward an underarm area of the jacket and dividing a rear portion of the jacket from a front portion of the jacket, a non-locking zipper extending along the generally vertical opening, oriented so as to close the opening when a handle of the zipper is pulled down to near the bottom edge of the jacket, a releasable plastic clip comprising two engageable clip components, one component secured to the front portion of the jacket near the bottom edge and the other component secured to the rear portion of the jacket near the bottom edge, the two clip components being configured to snap and lock together when one is pushed into the other, and a rip cord connected to one of the clip components and effective to release the clip when pulled outwardly, allowing the two clip components to pull apart, whereby pulling of the rip cord with one hand of a user, in a direction to pull one portion of the jacket away from the other, will release the clip, unzip the zipper and open the access opening, allowing quick access to an item stored under the jacket, which access can be with the user's other hand.

2. The jacket of claim 1, wherein the rip cord passes through an opening in the jacket such that a small handle on the outer end of the rip cord is accessible to the user.

3. The jacket of claim 1, wherein said one component of the plastic clip has a spring-biased pivoted rocker latch which engages a ledge over a barb of the other clip component when inserted into the one component so as to lock the components together, the rip cord being secured to the rocker latch to lift a forward end of the rocker latch against the spring bias releasing the barb of the other component.

4. The jacket of claim 1, further including hook and loop fasteners on each side of the access opening near the bottom of the jacket, positioned to engage together when the edge of one jacket portion is placed over the adjacent edge of the other jacket portion, holding the opening closed at the bottom of the jacket when the hook/loop fasteners are engaged, and the pulling of the rip cord being effective to release the hook and loop fasteners.

5. The jacket of claim 4, wherein the zipper handle is generally rectangular and defines a large central opening, sufficiently large such that the zipper handle can be sandwiched between the two hook and loop fastener sections and retained and essentially hidden in place between overlapped edges of the front and back portions of the jacket, essentially keeping the zipper slider from unintentional movement up the zipper path.

6. The jacket of claim 1, wherein the access opening and the zipper extend up to within about two inches below the arm.

7. The jacket of claim 1, wherein the zipper is concealed when closed by a flap covering the entire zipper and slider.

8. The jacket of claim 1, including a short strap connecting each of the two clip components to a respective portion of the jacket.

9. The jacket of claim 1, including said access opening, zipper, plastic clip and rip cord at both sides of the jacket.

* * * * *